US006367707B1

(12) United States Patent
Kang

(10) Patent No.: US 6,367,707 B1
(45) Date of Patent: Apr. 9, 2002

(54) BI-DIRECTIONAL FLOW SPOUT ATTACHMENT

(76) Inventor: Tae C. Kang, 349A W. Milford St., Glendale, CA (US) 91203

( * ) Notice: Subject to any disclaimer, the term of this patent is extended or adjusted under 35 U.S.C. 154(b) by 0 days.

(21) Appl. No.: 09/788,022

(22) Filed: Feb. 20, 2001

(51) Int. Cl.[7] ..... B05B 12/14

(52) U.S. Cl. ..... 239/26; 239/25; 239/24; 239/447

(58) Field of Search ..... 239/24, 25, 26, 239/27, 443, 444, 447

(56) References Cited

U.S. PATENT DOCUMENTS

| | | | | |
|---|---|---|---|---|
| 1,069,910 A | | 8/1913 | Taylor | |
| 1,105,547 A | | 7/1914 | Coffield | |
| 1,149,856 A | | 8/1915 | Piper | |
| 2,245,041 A | | 6/1941 | McCurdy | |
| 2,994,481 A | | 8/1961 | Blumberg | |
| 3,325,101 A | | 6/1967 | Cuschera | |
| 3,335,957 A | | 8/1967 | Jacobson | |
| 3,552,651 A | * | 1/1971 | Garrison | 239/25 |
| 4,072,270 A | | 2/1978 | Harmony | |
| 4,448,351 A | | 5/1984 | Aldinger et al. | |
| 4,537,350 A | * | 8/1985 | Apri | 239/25 |
| 4,552,306 A | * | 11/1985 | Litwak et al. | 239/24 |
| 4,934,597 A | * | 6/1990 | Crutcher | 239/447 |

* cited by examiner

*Primary Examiner*—Steven J. Ganey
(74) *Attorney, Agent, or Firm*—John K. Park; Park & Sutton LLP

(57) ABSTRACT

The present invention is a bi-directional spout apparatus for attachment to the spout of a conventional faucet that allows for either the upward or downward discharge of water. The first bore receives water flow from the spout. The second bore extends from the central cavity to the bottom surface. Water flows from the spout into the first bore and into the central cavity where it can be diverted into either the second bore or the third bore. A sliding regulator member can be used within the central cavity to regulate water flow.

7 Claims, 5 Drawing Sheets

BI-DIRECTIONAL FLOW SPOUT ATTACHMENT

BACKGROUND OF THE INVENTION

This invention relates to an attachment device for a faucet. More particularly, this invention relates to a spout attachment device for a faucet in which water can flow either upward or downward.

There are several different types of conventional faucets. All faucets have a handle and a spout. Disc and stem faucets have a handle that is twisted in a corresponding direction to turn water on and off. Cartridge and ball-type faucets have a handle with a lever, which is pulled up and down in a corresponding direction to turn water on and off. In conventional faucets, the spout discharges water in a downward direction.

It would be advantageous for a faucet to be able to discharge water either in the upward direction or in the downward direction. An advantage to having water discharged upward would be in rinsing one's mouth. One would not need a receptacle or to cup one's hand to collect water to rinse one's mouth. The user would simply open his or her mouth directly over the upwardly discharging water to rinse his or her mouth. Also, one could simply wash his or her face by placing the face in front of the upwardly discharging water.

It is an objective of the present invention to provide a device for attachment to a spout of a conventional faucet, which allows for either the upward or downward discharge of water.

SUMMARY OF THE INVENTION

The present invention is a bi-directional spout apparatus for attachment to the spout of a conventional faucet that allows for either the upward or downward discharge of water. Additionally, the present invention rotates and pivots to numerous positions that are most convenient for various activities and tasks.

The spout apparatus has a front end, back end, top surface, a bottom surface, a neck forming a hollow channel, and a central cavity. The spout apparatus attaches to the spout near the back end of the apparatus. The spout apparatus has a first bore, second bore, third bore, and the hollow channel. The first bore is located near the back end and extends from the top surface to the central cavity and receives water flow from the spout. The second bore extends from the central cavity to the bottom surface. The hollow channel extends from the front end into the central cavity, and the third bore is positioned near the front end and extends from the top surface to the hollow channel. Water flows from the spout into the first bore and into the central cavity where it can be diverted into either the second bore or the third bore. A sliding regulator member can be used within the central cavity to regulate water flow. Should the water flow into the second bore, it will be discharged from the spout device in the downward direction. Should the water flow into the third bore, it will be discharged from the spout in the upward direction.

In a further description of the parts of the bi-directional spout attachment, the invention includes a central body having a top surface, a bottom surface, a front end, and a back end. The central cavity can be fed by the first bore. The first bore is located near the back end, extending from the top surface to the central cavity. The second bore extends from the central cavity to the bottom surface. A neck forming a hollow channel extends from the central cavity to near the front end. A third bore located near the front end extends from the hollow channel to the top surface.

The regulator member positioned within the central body has a head portion, a shaft and a knob. The head portion lies within the central cavity. The shaft extends from the central cavity to the exterior of the central body. The knob is positioned opposite the head portion and the knob is outside the central body. By movement of the knob the flow direction regulator member is movable between a first position and a second position.

The spring is attached to the regulator member and the spring is also attached to the inner wall of the central cavity. When the spring is fully extended to a resting state the spring applies force to maintain the flow direction regulator member in the first position. In the first position the head portion covers access to the third bore and thereby directs water flow received from the first bore into the second bore. Alternately, the hollow channel may be positioned between the central cavity and the third bore. In this alternate, the head when in the first position would block access to the hollow channel, which would then prevent the flow of water into the third bore.

When the spring is in a compressed state the flow direction regulator member is in the second position where the head portion covers access to the second bore, and thereby directs water flow received from the first bore into the hollow channel or the third bore. The pressure from the water flowing from the first bore into the third bore maintains the spring in the compressed state and the regulator member in the second position. When the water flow ceases, the force of the compressed spring returns the spring to the first position and a resting state. The spring can encircle the shaft of the regulator member.

The pivoting member attaches to the top surface at the first bore. The pivoting member has a vertical axis and a horizontal axis. The pivoting member can make a circumferential rotation around the vertical axis and pivots about the horizontal axis. The first bore extends through the pivoting member. The pivoting member can be a ball joint.

BRIEF DESCRIPTION OF THE DRAWING

With the above and additional objects and advantages in view, as will hereinafter appear, this invention comprises the devices, combinations and arrangements of parts hereinafter described, by way of example, and illustrated in the accompanying drawings of a preferred embodiment.

DETAILED DESCRIPTION OF THE PREFERRED EMBODIMENTS

Figure 1:
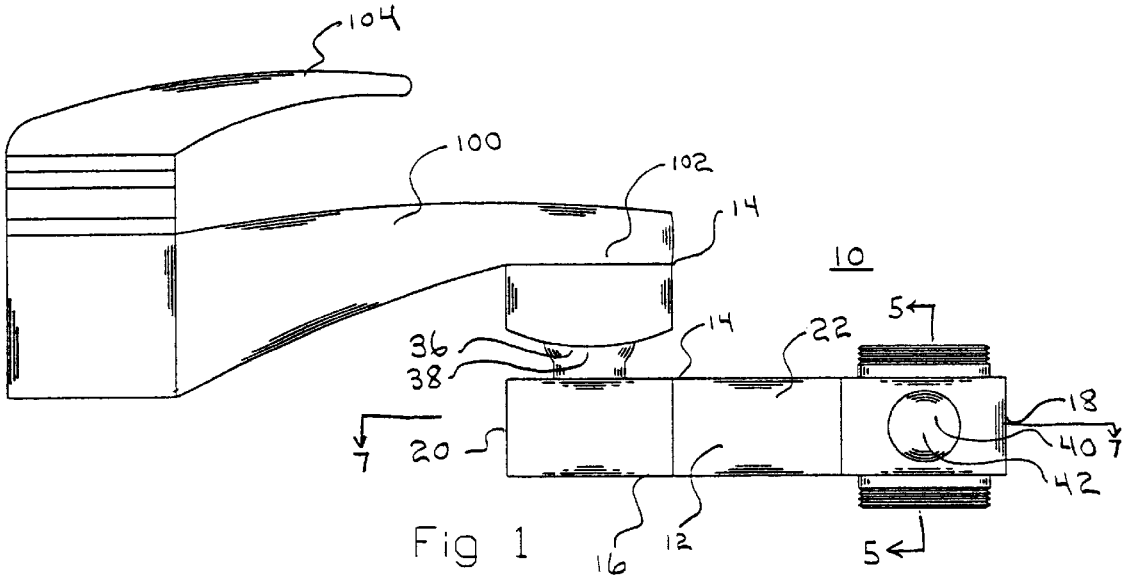
FIG. 1 is a side view of the present invention.
Figure 1A:
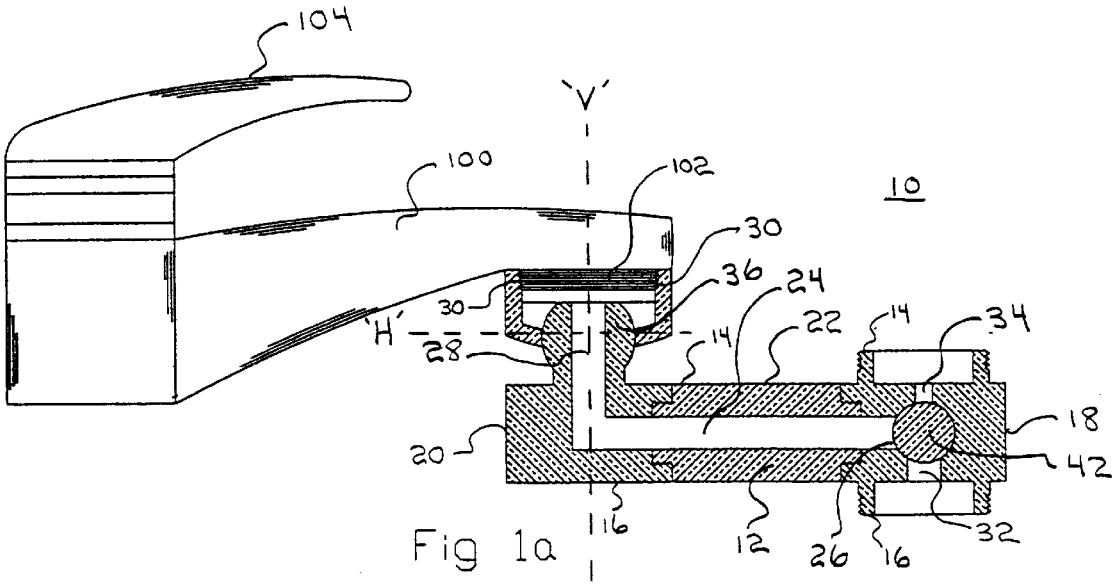
FIG. 1*a* is a side cross sectional view of the present invention.

FIGS. 1 and 1*a* illustrate a bi-directional spout attachment 10 for attachment to a faucet 100. The faucet 100 with a spout 102 and a handle 104 are illustrated, with the spout attachment 10 connected to the spout 102.

The spout attachment 10 has a central body 12 having a top surface 14, a bottom surface 16, a front end 18, a back end 20, a neck 22 that forms a hollow channel 24, and a central cavity 26. A first bore 28 located near the back end 20 extends from the top surface 14 to the hollow channel. An interface surface 30 that connects the spout attachment 10 to the faucet spout 102 is located at the top surface 14 and encircles the first bore 28. The interface surface 30 is typically a threaded connection that matches to the threads of the faucet spout 102. In this first embodiment, water flows from the spout 102 through the first bore 28 into the hollow channel 24 and central body 12. The hollow channel 24 extends to the central cavity 26. A second bore 32 that provides for the downward flow of water extends from the central cavity 26 to the bottom surface 16. A third bore 34 located near the front end 18 extends from the central cavity 26 to the top surface 14. The third bore 34 creates an upward flow of water.

A pivoting member 36 is attached to the top surface 14 at the first bore 28. The pivoting member 36 has a vertical axis 'V' and a horizontal axis 'H'. The pivoting member 36 can make a circumferential rotation around the vertical axis 'V' and pivots about the horizontal axis 'H'. The first bore 28 extends through the pivoting member 36.

The pivoting member 36 has a great range of flexibility in positioning due to the circumferential rotation around the vertical axis 'V' and pivoting about the horizontal axis 'H'. Many applications including drinking, washing of hands, filling of containers and cleaning of clothes can be more convenient when the spout attachment 10 is moved in varying positions. The cleaning and washing of small infants in the sink is significantly easier when the spout attachment 10 can be moved back and forth to different positions.

The pivoting member 36 can be a ball joint 38. Ball joints 38 are well known in the mechanical arts, when used for rotating or pivoting a mechanism about the horizontal axis 'H' and the vertical axis 'V' of the mechanism. In one embodiment the pivoting member 36 can pivot about 90 degrees, encompassing between about 45 degrees above the horizontal axis 'H' and about 45 degrees below the horizontal axis 'H'. This range of pivoting allows for sufficient positioning of the spout attachment 10 and the flow of water in various applications. One application is the placing of large containers under the spout attachment 10 for filling. When the pivoting member 36 is pivoted above the horizontal axis 'H', larger containers fit easily under the spout attachment 10 rather than being blocked by the rigid positioning of a non-pivoting spout attachment 10.

The first bore 28 extends through the pivoting member 36 from the bottom of the pivoting member 36 to the top of the pivoting member 36. Water flows through the pivoting member 36 via the first bore 28, then through the hollow channel 24 into the central cavity 26. A regulator member 40 is position within and about the central body 12. The knob 42 of the regulator member 40 is shown on the exterior of the central body 12.

Figure 2:
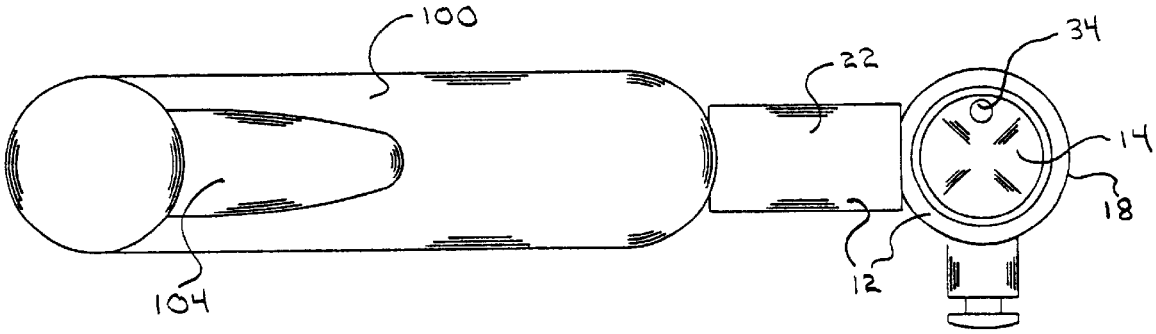
FIG. 2 is a top plan view of the present invention.

FIG. 2 shows a top plan view of the spout attachment 10 connected to the faucet 100. The neck 22 containing the hollow channel 24 extends from the faucet 100 to the central cavity 26 that is within the central body 12. The third bore 34 exits the central body 12 at the top surface 14 near the front end 18.

Figure 3:
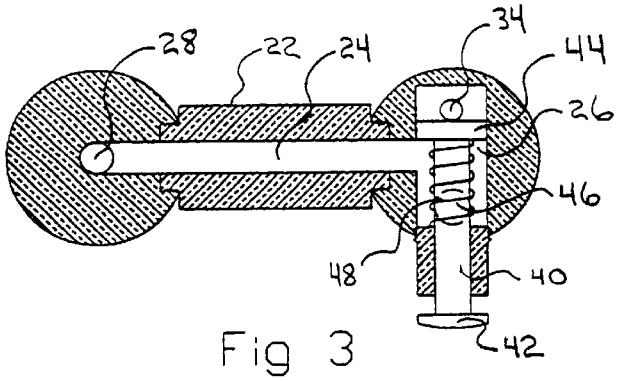
FIG. 3 is a top plan cross sectional view of the present invention as cut along the 7—7 line of FIG. 1.
Figure 4:
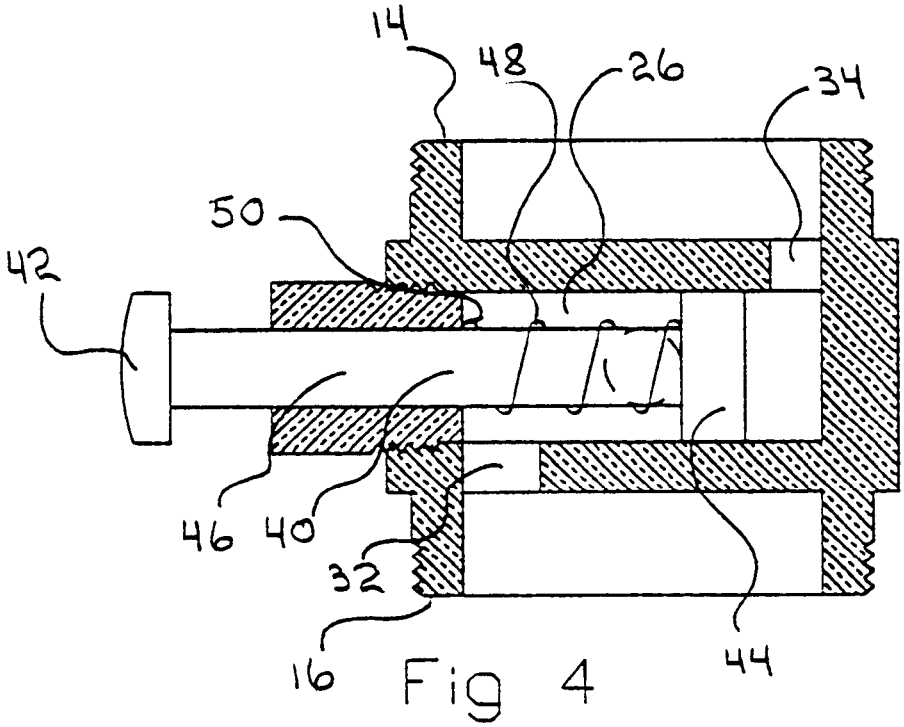
FIG. 4 is a front cross sectional view of the present invention as cut along the 5—5 line of FIG. 1 positioned for the downward flow of water.
Figure 5:
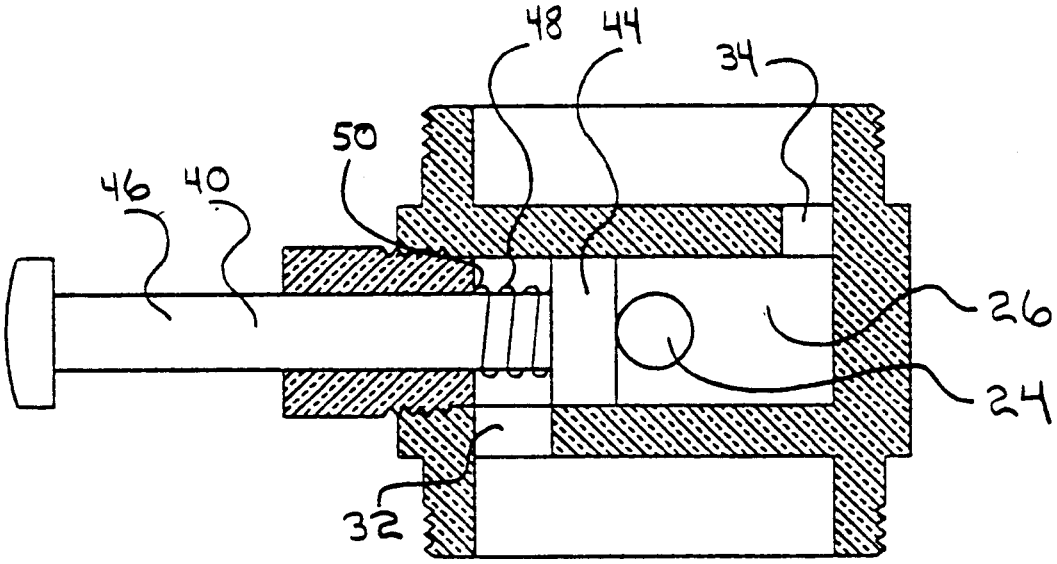
FIG. 5 is a front cross sectional view of the present invention as cut along the 5—5 line of FIG. 1 positioned for the upward flow of water.

As shown in FIGS. 3–5, the regulator member 40 controls the flow of water between the second bore 32 and the third bore 34. In FIG. 3, the regulator member 40 has a head portion 44 lying within the central cavity 26 and a knob 42 opposite the head portion 44. The knob 42 is positioned on the exterior of the spout attachment 10. A shaft 46 extends from the central cavity 26 to the exterior of the central body 12. The regulator member 40 is slideable between a first position and a second position. The user can pull or push the knob 42 to slide the regulator member 40 between the two positions. A spring 48 provides pressure to retain the regulator member 40 in the first position, which provides for the usual downward flow of water. In this first embodiment the neck 22 and hollow channel 24 are located between the first bore 28 and the central cavity 26. In a second embodiment, described later, the central cavity 26 will be fed directly from the first bore 28 with the hollow channel 24 then feeding from the central cavity 26 to just the third bore 34.

FIG. 4 is a front cross sectional view of the spout attachment 10 as cut along the 5—5 line of FIG. 1, positioned for the downward flow of water. In FIG. 4, the regulator member 40 is in the first position, where the head portion 44 covers the third bore 34 and directs water flow from the central cavity 26 into the second bore 32. Water flows in the downward direction as it exits the spout attachment 10 via the second bore 32. To keep the regulator member 40 in the first position, a spring 48 can be connected to the inner wall 50 of the central cavity 26, which is biased to urge the head portion 44 away from the inner wall 50. The spring 48 encircles the shaft 46 of the regulator member 40. When the spring 48 is fully extended to a resting state the spring 48 applies force to maintain the regulator member 40 in the first position, causing the head portion 44 to cover the third bore 34 and thereby directs water flow received from the first bore 28 into the second bore 32. Although not shown, an aerator can be placed over the second bore 32 at the bottom surface 16 to aerate the flow of water as it passes therethrough.

FIG. 5 is also a front cross sectional view of the spout attachment 10 cut along the 5—5 line of FIG. 1. Where FIG. 4 showed a downward flow of water, FIG. 5 depicts positioning for the upward flow of water. The regulator member 40 is in the second position, where the head portion 44 covers the second bore 32 and directs water flow from the central cavity 26 into the third bore 34. Water flows in the upward direction as it exits the central cavity 26 via the third bore 34.

Water flows from the hollow channel 24 into the central cavity 26. The pressure from the water flowing through the central cavity 26 into the third bore 34 maintains the spring 48 in the compressed state and the regulator member 40 in the second position. Although not shown, to control the upward flow of water as it thrusts out the third bore 34, a flow restrictor can be placed over the third bore 34 at the top surface 14. Flow restrictors are of the type well known in the art, which allow a uniform stream of water to be discharged upward.

In a second embodiment as shown in FIG. 6 through FIG. 9, the bi-directional spout attachment 10 has the second bore 32 and central cavity 26 positioned beneath the spout 102 and the first bore 28. The neck 22 defining the hollow channel 24 then extends out to the front end 18 where the third bore 34 is located. This second embodiment is in contrast to the first embodiment, where the central cavity 26 and second bore 32 were located toward the front end 18 and were fed by the hollow channel 24. As in the first embodiment, the spout apparatus 10 attaches to the spout 102 near the back end 20.

The spout attachment 10 has towards the back end 20 the first bore 28 extending from the top surface 14 to the central cavity 26 for receiving water flow from the spout 102. The second bore 32 extends from the central cavity 26 to the bottom surface 16. The hollow channel 24 extends from the central cavity 26 to the front end 18. The third bore 34 located toward the front end 18 extends from the hollow channel 24 to the top surface 14. Water enters the first bore 28 through the spout 102 and into the central cavity 26 where it can flow into either the second bore 32 or through the hollow channel 24 to the third bore 34. The pivoting member 36 encircles the first bore 28, providing varied positions of placement for the spout attachment 10.

Figure 6:
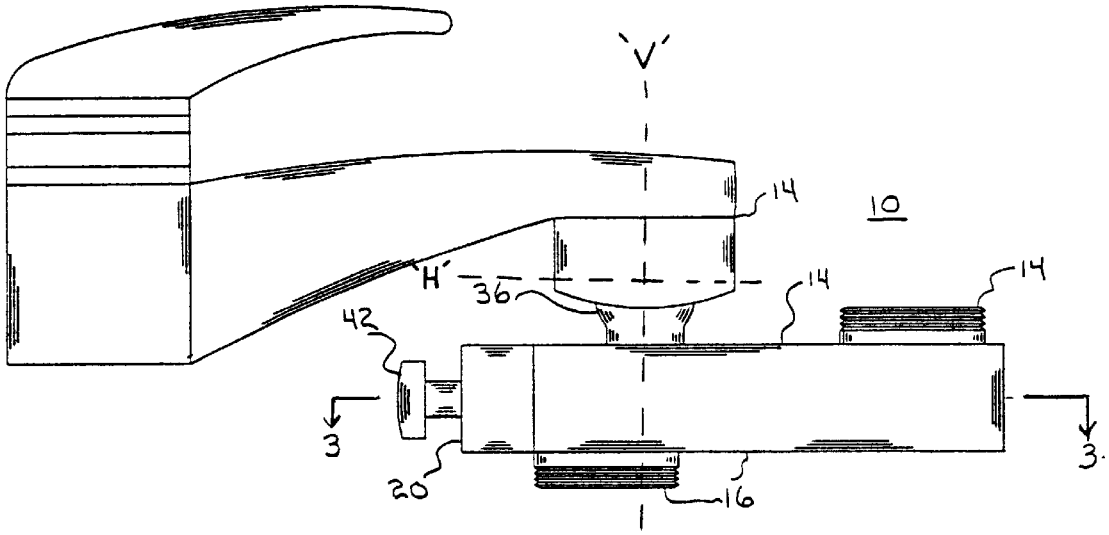
FIG. 6 is a side view of a second embodiment of the present invention.
Figure 7:
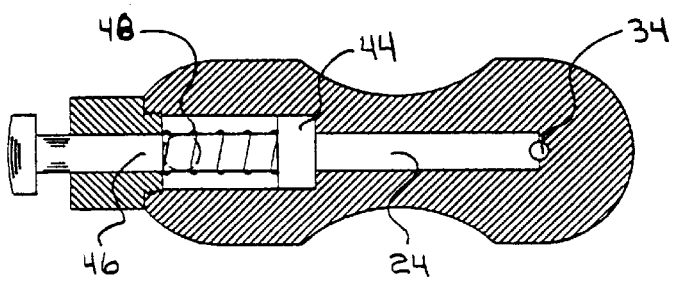
FIG. 7 is a top plan cross sectional view of the spout apparatus of the second embodiment of the present invention as cut along the 3—3 line of FIG. 6.
Figure 8:
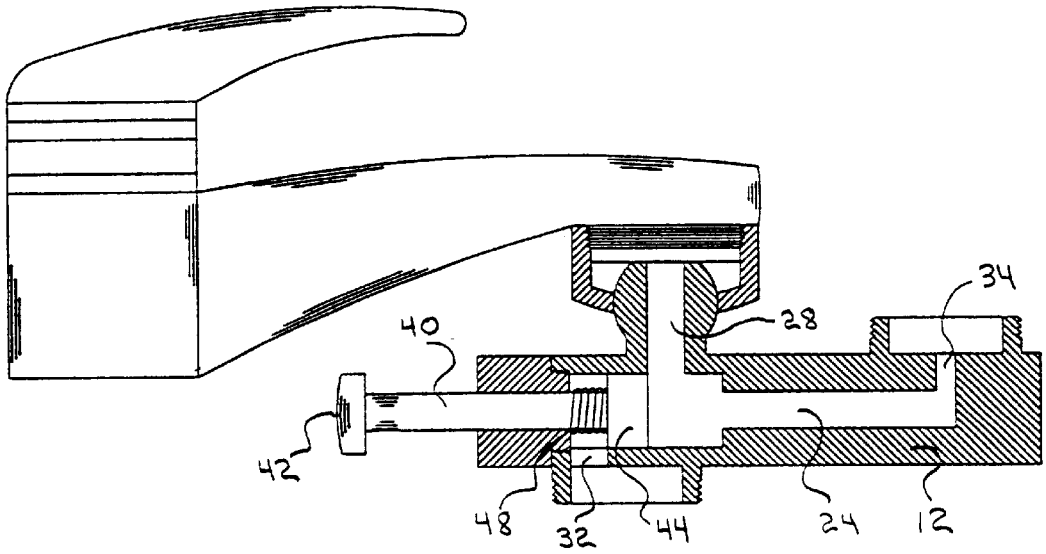
FIG. 8 is a side cross sectional view of the second embodiment of the present invention positioned to discharge water in the upward direction.

FIGS. 6 through 8 illustrate the regulator member 40 extending through the spout attachment 10. The regulator member 40 operates in a similar manner as that described in FIGS. 3 through 5, except that in the first position the head covers the hollow channel 24 rather than directly covering the entrance to the third bore 34.

The regulator member 40 has the head portion 44 lying within the central cavity 26 and the knob 42 opposite the head portion 44. The knob 42 lies on the exterior of the central body 12 and can be handled by the user to slide the regulator member 40 between a first position and a second position.

Figure 6A:
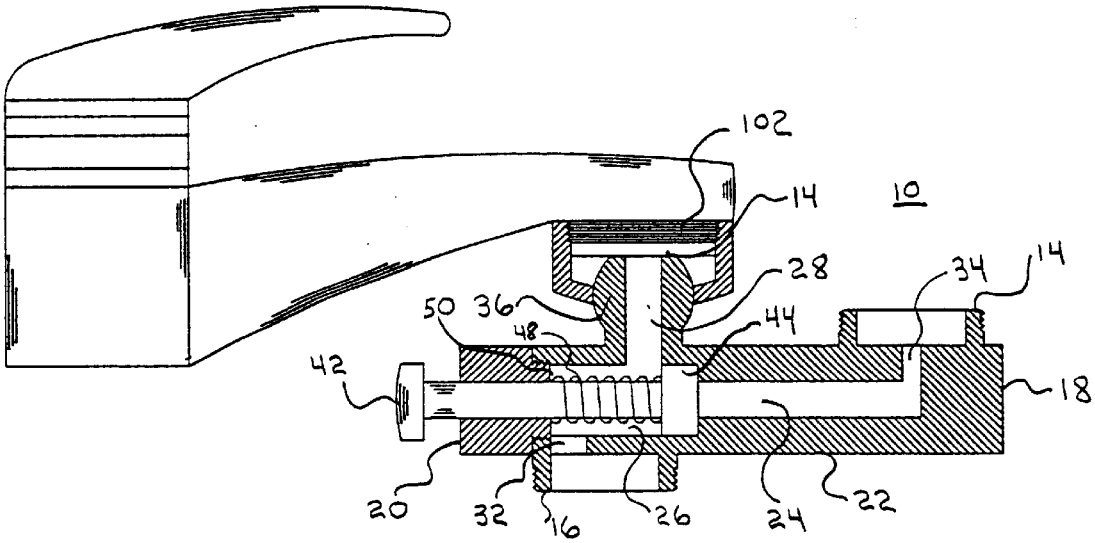
FIG. 6*a* is a side cross sectional view of the second embodiment of the present invention positioned to direct water flow downward.

As shown in FIG. 6*a*, when a regulator member 40 is in the first position the head portion 44 covers the hollow channel 24 leading to the third bore 34 and thereby directs water flow received from the first bore 28 into the second bore 32. A spring 48 can be attached to the inner wall 50 of the central cavity 26, which is biased to urge the head portion 44 away from the inner wall 50 to also maintain the first position. As previously described, the pivoting member 36 can make a circumferential rotation around the vertical axis 'V' and pivots about the horizontal axis 'H'.

FIG. 7, which is cut along the 3—3 line of FIG. 6, illustrates the first position where the head is blocking the hollow channel 24 and the third bore 34. The spring 48 is in the extended position and encircles the shaft 46.

In the second position as shown in FIG. 8, the head portion 44 prevents access to the second bore 32 and thereby directs water flow received from the first bore 28 into the hollow channel. Water flow then travels through the hollow channel 24 and into the third bore 34 and exits in an upward direction from the third bore 34. When the knob 42 is pulled out water pressure can be sufficient to maintain the spring 48 in a compressed state and the regulator member 40 in the second position.

Figure 9:
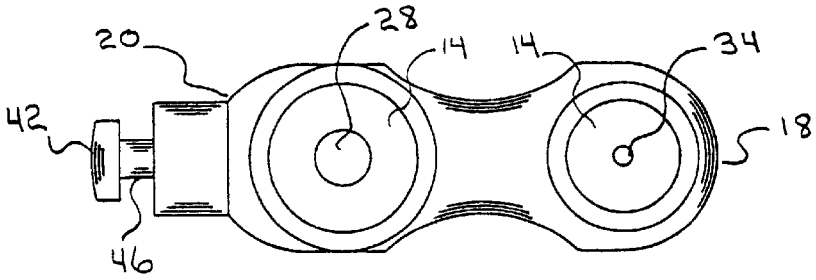
FIG. 9 is a top plan view of the spout attachment apparatus of the second embodiment, of the present invention as shown in FIG. 6, but with the faucet removed from view.

FIG. 9 is a top view of the spout apparatus 10 depicting where the first bore 28 and third bore 34 open at the top surface 14. The first bore 28 is near the back end 20 and the third bore 34 is positioned near the front end 18. The knob 42 and shaft 46 are shown in the first position where water would flow downward through the second bore 32.

While preferred embodiments of the invention has been described and illustrated for purposes of clarity and example, it should be understood that many changes, substitutions and modifications to the described embodiments will be apparent to those having skill in the art in light of the foregoing disclosure without departing from the scope and spirit of the present invention which is defined by the claim which will follow.

What is claimed is:

1. A bi-directional spout attachment for attachment to a faucet spout comprising:

a) a central body having a top surface, a bottom surface, a front end, a back end, a central cavity, a first bore located near the back end extending from the top surface to the central cavity, a second bore extending from the central cavity to the bottom surface, a neck forming a hollow channel extending from the central cavity to near the front end, a third bore located near the front end extending from the hollow channel to the top surface;

b) a regulator member positioned within the central body, having a head portion, a shaft and a knob, wherein the head portion lies within the central cavity, the shaft extends from the central cavity to the exterior of the central body, the knob is positioned opposite the head portion, and the knob lying outside the central body; wherein by movement of the knob the flow direction regulator member is movable between a first position and a second position; and c) a spring attached to the regulator member and attached to the inner wall of the central cavity;

whereby when the spring is fully extended to a resting state the spring applies force to maintain the flow direction regulator member in the first position, causing the head portion to cover access to the third bore and thereby directs water flow received from the first bore into the second bore; and whereby when the spring is in a compressed state the flow direction regulator member is in the second position where the head portion covers access to the second bore, and thereby directs water flow received from the first bore into the third bore, whereby the pressure from the water flowing from the first bore into the third bore maintains the spring in the compressed state and the regulator member in the second position; whereby when the water flow ceases, the force of the compressed spring returns the spring to the first position and a resting state.

2. The bi-directional spout attachment of claim 1 wherein the spring encircles the shaft of the regulator member.

3. A bi-directional spout attachment for attachment to a faucet spout comprising:

a) a central body having a top surface, a bottom surface, a front end, a back end, a central cavity, a first bore located near the back end extending from the top surface to the central cavity, a second bore extending from the central cavity to the bottom surface, a neck forming a hollow channel extending from the central cavity to near the front end, a third bore located near the front end extending from the hollow channel to the top surface;

b) a regulator member positioned within the central body, having a head portion, a shaft and a knob, wherein the head portion lies within the central cavity, the shaft extends from the central cavity to the exterior of the central body, the knob is positioned opposite the head portion, and the knob lying outside the central body; wherein by movement of the knob the flow direction regulator member is movable between a first position and a second position; and c) a spring attached to the regulator member and attached to the inner wall of the central cavity;

whereby when the spring is fully extended to a resting state the spring applies force to maintain the flow direction regulator member in the first position, causing the head portion to cover access to the third bore and thereby directs water flow received from the first bore into the second bore; and whereby when the spring is in a compressed state the flow direction regulator member is in the second position where the head portion covers access to the second bore, and thereby directs water flow received from the first bore into the third bore, whereby the pressure from the water flowing from the first bore into the third bore maintains the spring in the compressed state and the regulator member in the second position; and whereby when the water flow ceases, the force of the compressed spring returns the spring to the first position and a resting state; and d) a pivoting member attached to the top surface at the first bore, the pivoting member having a vertical axis and a horizontal axis;

whereby the pivoting member can make a circumferential rotation around the vertical axis, whereby the pivoting member pivots about the horizontal axis, whereby the first bore extends through the pivoting member.

4. The faucet attachment of claim 3 wherein the pivoting member is a ball joint.

5. The bi-directional spout attachment of claim 4 wherein the spring encircles the shaft of the regulator member.

6. A bi-directional spout attachment for attachment to a faucet spout comprising:

a) a central body having a top surface, a bottom surface, a front end, a back end, a neck forming a hollow channel extending from near the back end to near the front end, a central cavity located near the front end connected to the hollow channel, a first bore located near the back end extending from the top surface to the hollow channel, a second bore located near the front end extending from the central cavity to the bottom surface, and a third bore located near the front end extending from the central cavity to the top surface;

b) a regulator member positioned within the central body, having a head portion, a shaft and a knob, wherein the head portion lies within the central cavity, the shaft extends from the central cavity to the exterior of the central body, the knob is positioned opposite the head portion, and the knob lying outside the central body; wherein by movement of the knob the flow direction regulator member is movable between a first position and a second position; and c) a spring attached to the regulator member and attached to the inner wall of the central cavity;

whereby when the spring is fully extended to a resting state the spring applies force to maintain the flow direction regulator member in the first position, causing the head portion to cover access to the third bore and thereby directs water flow received from the hollow channel into the second bore; and whereby when the spring is in a compressed state the flow direction regulator member is in the second position where the head portion covers access to the second bore, and thereby directs water flow received from the first bore and hollow channel into the third bore, whereby the pressure from the water flowing from the hollow channel into the third bore maintains the spring in the compressed state and the regulator member in the second position; and d) a pivoting member attached to the top surface at the first bore, the pivoting member having a vertical axis and a horizontal axis;

whereby the pivoting member can make a circumferential rotation around the vertical axis; whereby the pivoting member pivots about the horizontal axis, whereby the first bore extends through the pivoting member.

7. The faucet attachment of claim 6 wherein the pivoting member is a ball joint.

* * * * *